US011262069B2

(12) United States Patent
Cowan et al.

(10) Patent No.: US 11,262,069 B2
(45) Date of Patent: Mar. 1, 2022

(54) METHOD AND SYSTEM FOR AUTO-ADJUSTING AN ACTIVE RANGE OF A GAS COOKING APPLIANCE

(71) Applicant: Midea Group Co., Ltd., Foshan (CN)

(72) Inventors: Richard W. Cowan, Louisville, KY (US); Vern A. Neal, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 16/911,999

(22) Filed: Jun. 25, 2020

(65) Prior Publication Data

US 2021/0404658 A1 Dec. 30, 2021

(51) Int. Cl.

| | |
|---|---|
| ***F23N 1/00*** | (2006.01) |
| ***F24C 3/12*** | (2006.01) |
| ***F23N 5/10*** | (2006.01) |
| ***F23N 5/12*** | (2006.01) |

(52) U.S. Cl.

CPC ..... *F23N 1/002* (2013.01); *F23N 5/105* (2013.01); *F23N 5/126* (2013.01); *F24C 3/128* (2013.01); *F23N 2235/12* (2020.01); *F23N 2239/04* (2020.01); *F23N 2241/08* (2020.01)

(58) Field of Classification Search

None

See application file for complete search history.

(56) References Cited

U.S. PATENT DOCUMENTS

| | | | | |
|---|---|---|---|---|
| 3,726,296 | A | 4/1973 | Friedland et al. | |
| 4,249,884 | A | 2/1981 | Cade | |
| 4,361,164 | A * | 11/1982 | Sakakibara | F02D 41/20 137/14 |
| 4,498,863 | A | 2/1985 | Hanson et al. | |
| 4,513,909 | A | 4/1985 | Bartels | |
| 4,518,345 | A | 5/1985 | Mueller et al. | |
| 5,234,196 | A | 8/1993 | Harris | |
| 5,488,969 | A | 2/1996 | King et al. | |
| 5,924,857 | A | 7/1999 | Frasnetti et al. | |
| 5,984,663 | A | 11/1999 | Joyce | |

(Continued)

FOREIGN PATENT DOCUMENTS

| | | |
|---|---|---|
| CN | 201310941 Y | 9/2009 |
| CN | 103867772 A | 6/2014 |

(Continued)

OTHER PUBLICATIONS

U.S. Patent and Trademark Office, Final Office Action issued in U.S. Appl. No. 15/941,890 dated Oct. 28, 2020.

(Continued)

*Primary Examiner* — Jason Lau

(74) *Attorney, Agent, or Firm* — Middleton Reutlinger

(57) ABSTRACT

A cooking appliance includes a gas cooking element, an electromechanical valve fluidly coupled with the gas cooking element to regulate a flow of gas to the cooking element, a flame detector configured to detect an active state of a flame for the gas cooking element, a manually-actuated user control movable over a range of positions, and a controller coupled to the electromechanical valve, the flame detector, and the manually-actuated user control. The controller is configured to initiate a calibration process to determine an active range for the gas cooking element.

25 Claims, 6 Drawing Sheets

(56) References Cited

U.S. PATENT DOCUMENTS

| | | | | |
|---|---|---|---|---|
| 5,988,205 | A | 11/1999 | Eggleston | |
| 6,016,832 | A | 1/2000 | Vars et al. | |
| 6,206,687 | B1 | 3/2001 | Redington | |
| 6,247,919 | B1 | 6/2001 | Welz, Jr. et al. | |
| 6,283,145 | B1 | 9/2001 | Fenn | |
| 6,314,992 | B1 | 11/2001 | Ohmi et al. | |
| 6,539,968 | B1 | 4/2003 | White et al. | |
| 7,360,534 | B2 | 4/2008 | Krupp | |
| 7,861,740 | B2 | 1/2011 | Phallen et al. | |
| 8,635,899 | B2 | 1/2014 | Bailey | |
| 8,752,577 | B2 | 6/2014 | Santinanavat et al. | |
| 8,863,734 | B2 | 10/2014 | Shaffer | |
| 9,453,648 | B2 | 9/2016 | Schultz et al. | |
| 9,638,425 | B2 | 5/2017 | Inada et al. | |
| 9,645,585 | B2 | 5/2017 | Nguyen et al. | |
| 9,657,946 | B2 | 5/2017 | Young et al. | |
| 9,951,960 | B2 | 4/2018 | Spano | |
| 10,240,789 | B2 | 3/2019 | Deng | |
| 10,532,821 | B2 | 1/2020 | Freeth et al. | |
| 2004/0055359 | A1 | 3/2004 | Ketler et al. | |
| 2005/0099256 | A1 | 5/2005 | Subramanian et al. | |
| 2006/0059987 | A1 | 3/2006 | Melville et al. | |
| 2008/0221822 | A1 | 9/2008 | Laverdiere et al. | |
| 2010/0112500 | A1 | 5/2010 | Maiello et al. | |
| 2010/0180882 | A1 | 7/2010 | Oberhomburg et al. | |
| 2012/0183910 | A1* | 7/2012 | Jaaz | F24C 3/126 431/6 |
| 2016/0085317 | A1* | 3/2016 | Agarwal | G06F 3/013 345/156 |
| 2016/0178213 | A1 | 6/2016 | Petersen et al. | |
| 2016/0239026 | A1 | 8/2016 | Nagase et al. | |
| 2017/0009666 | A1 | 1/2017 | Wolff et al. | |
| 2017/0322105 | A1 | 11/2017 | Guixeras | |
| 2018/0008095 | A1 | 1/2018 | Bennett et al. | |
| 2018/0127109 | A1 | 5/2018 | Freeth et al. | |
| 2018/0301301 | A1 | 10/2018 | Bach | |
| 2019/0301743 | A1 | 10/2019 | Cowan | |
| 2020/0408402 | A1* | 12/2020 | Gerdes | F23D 14/64 |

FOREIGN PATENT DOCUMENTS

| | | | |
|---|---|---|---|
| CN | 106958666 | A | 7/2017 |
| EP | 0833106 | B1 | 11/2001 |
| EP | 1522790 | A2 | 4/2005 |
| GB | 2362706 | A | 11/2001 |
| KR | 20160127651 | A | 11/2016 |
| KR | 20170017086 | A | 2/2017 |
| WO | WO2014091379 | A1 | 6/2014 |

OTHER PUBLICATIONS

U.S. Patent and Trademark Office, Advisory Action issued in U.S. Appl. No. 15/941,890 dated Feb. 18, 2021.

U.S. Patent and Trademark Office, Notice of Allowance issued in U.S. Appl. No. 15/941,890 dated Jul. 22, 2021.

Applied Control Concepts, Boiler Calibration, https://www.appliedcc.com/index.php/2011-07-25-22-49-08/combustion/25-combustion/calibrations/34-boiler-calibrations-article, Retrieved on Apr. 1, 2019.

B, Billy, Homebrew Academy, Brutus 10 Build: The Gas System, https://homebrewacademy.com/brutus-10-gas-system/, May 18, 2012, Retrieved on Apr. 1, 2019.

Valveuser Magazine, Issue 32, BVAA. Spring 2015.

Appliances Connection "Premier" www.appliancesconnection.com. First Retrieved on Sep. 20, 2017.

U.S. Patent and Trademark Office, Office Action issued in U.S. Appl. No. 15/941,890 dated Apr. 15, 2020.

International Search Report and Written Opinion of PCT Ser. No. PCT/CN2018/123151, dated Mar. 28, 2019.

* cited by examiner

METHOD AND SYSTEM FOR AUTO-ADJUSTING AN ACTIVE RANGE OF A GAS COOKING APPLIANCE

BACKGROUND

Cooking today is in many respects as much an art as a science, and care must often be taken during cooking to ensure that food is neither overcooked nor undercooked, which often requires constant control of a cooking appliance, e.g., a range, stovetop, oven, or the like. In many instances, the cooking elements are controlled by manually-actuated user controls such as knobs, which may be turned to particular rotational positions to control a heat outputs of the associated cooking elements. For cooking elements such as gas burners, manually-actuated user controls are mechanically or electrically coupled to gas valves that regulate the flow of gas to the gas burners. Some gas cooking appliances, for example, use electromechanical valves that are controlled electronically, and the associated manually-actuated user controls incorporate encoders or other types of rotational position sensors that vary the flow rate of gas through the electromechanical valves.

One issue that arises when using electromechanical valves, however, is that there is generally a point below which the flow of gas through an electromechanical valve is insufficient to maintain a flame in a downstream gas burner. Moreover, this point may vary for a particular electromechanical valve based upon a number of factors, e.g., the size or maximum output of the downstream gas burner, the input gas pressure, the input gas type (e.g., natural gas vs. propane), etc. Thus, if a user turns manually-actuated user control to a position that causes an associated electromechanical valve to lower the flow rate of the gas below that which is sufficient to maintain a flame, a risk exists that the flame could extinguish.

A need therefore exists in the art for an improved manner of controlling an electromechanical valve for a gas cooking appliance.

SUMMARY

The herein-described embodiments address these and other problems associated with the art by providing in one aspect a cooktop appliance that may include a plurality of gas burners; a plurality of electromechanical valves, each of which fluidly coupled with one of the plurality of gas burners to regulate a gas flow rate thereto; one or more flame detectors positioned to detect an active state of a flame for each of the plurality of gas burners; a plurality of manually-actuated user controls, each of which movable over a range of positions; and a controller coupled to the plurality of electromechanical valves, the one or more flame detectors, and the plurality of manually-actuated user controls to selectively control the plurality of electromechanical valves to regulate output levels of the plurality of gas burners in response to user input received through the plurality of manually-actuated user controls. The controller may be configured to initiate a calibration process to determine an active range for each of the plurality of gas burners, and the controller may determine the active range for a first gas burner among the plurality of gas burners by controlling a first electromechanical valve for the first gas burner when the first gas burner is active to reduce the gas flow rate to the first gas burner while detecting the flame of the first gas burner with a first flame detector among the one or more flame detectors until the flame is detected to be extinguished to determine a minimum valve position of the electromechanical valve for the first gas burner at which the flame can remain alight.

In some embodiments, the controller may be further configured to determine a minimum setting for the active range by adding a predetermined value to the determined minimum valve position of the first electromechanical valve. In some embodiments, the controller may be further configured to determine a maximum setting for the active range based on a size of the first gas burner, a type of the first gas burner, a size of the first electromechanical valve, a type of the first electromechanical valve, and/or a type of gas being supplied to the first gas burner.

In some embodiments, the plurality of manually-actuated user controls may include a first manually-actuated user control assigned to the first electromechanical valve, and the controller is further configured to map the range of positions of the first manually-actuated user control to the determined active range for the first electromechanical valve. In some embodiments, the controller may be further configured to map the range of positions of the first manually-actuated user control to the determined active range for the electromechanical valve such that a minimum position in the range of positions of the first manually-actuated user control corresponds to the minimum setting for the determined active range for the electromechanical valve. In some embodiments, the controller may be further configured to map the range of positions of the first manually-actuated user control to the determined active range for the electromechanical valve further such that a maximum position in the range of positions of the first manually-actuated user control corresponds to a maximum setting for the determined active range for the electromechanical valve.

In some embodiments, the controller may be further configured to map the range of positions of the first manually-actuated user control to the determined active range for the electromechanical valve by applying a scaling factor. In some embodiments, the controller may be further configured to map the range of positions of the first manually-actuated user control to the determined active range for the electromechanical valve by applying a constant offset.

In some embodiments, the controller may be further configured to map the range of positions of the first manually-actuated user control to the determined active range for the electromechanical valve based upon a state of one or more other electromechanical valves among the plurality of electromechanical valves. In some embodiments, the controller may be configured to remap the range of positions of the first manually-actuated user control to the determined active range for the first electromechanical valve in response to a change in state of one or more other electromechanical valves among the plurality of electromechanical valves and dynamically adjust a position of the first electromechanical valve in response thereto.

In some embodiments, the controller may be further configured to control each other gas burner among the plurality of gas burners to operate at a maximum output level when determining the active range for the first gas burner. In some embodiments, the controller may be further configured to deactivate each other gas burner among the plurality of gas burners when determining the active range for the first gas burner. In some embodiments, the controller may be further configured to operate each other gas burner among the plurality of gas burners at each of a plurality of output levels when determining the active range for the first gas burner.

In some embodiments, a cooking appliance may include a gas cooking element; an electromechanical valve fluidly coupled with the gas cooking element to regulate a gas flow rate thereto; a flame detector configured to detect an active state of a flame for the gas cooking element; a manually-actuated user control movable over a range of positions; and a controller coupled to the electromechanical valve, the flame detector, and the manually-actuated user control to selectively control the electromechanical valve to regulate an output level of the gas burner in response to user input received through the manually-actuated user control. The controller may be configured to initiate a calibration process to determine an active range for the gas cooking element, and the controller may determine the active range for the gas cooking element by controlling the electromechanical valve for the gas cooking element when the gas cooking element is active to reduce the gas flow rate to the gas cooking element while detecting a flame of the gas cooking element with the flame detector until the flame is detected to be extinguished to determine a minimum valve position of the electromechanical valve for the gas cooking element at which the flame can remain alight.

In some embodiments, the cooking appliance may include a cooktop, and the cooking element may be a burner. In some embodiments, the cooking appliance may further include a plurality of electromechanical valves, a plurality of manually-actuated user controls, and a plurality of burners. Each of the plurality of electromechanical valves may correspond to a respective manually-actuated user control among the plurality of manually-actuated user controls, and each of the plurality of electromechanical valves and the respective manually-actuated user control therefor may further correspond to a respective burner among the plurality of burners. In some embodiments, the plurality of burners may vary in size and/or output capacity.

In some embodiments, a method of determining an active range for a gas cooking element may include igniting the gas cooking element; controlling an electromechanical valve coupled with the gas cooking element to reduce a gas flow rate to the gas cooking element; detecting a flame of the gas cooking element to determine when the flame is extinguished; and determining a minimum valve position of the electromechanical valve for the gas cooking element at which the flame can remain alight.

In some embodiments, the method may further include determining a minimum setting for the determined active range by adding a predetermined value to the determined minimum valve position of the electromechanical valve. In some embodiments, the method may further include determining a maximum setting for the determined active range based on a size of the gas cooking element, a type of the gas cooking element, a size of the electromechanical valve, a type of the electromechanical valve, and/or a type of gas being supplied to the gas cooking element.

In some embodiments, the method may further include mapping the range of positions of the manually-actuated user control to the determined active range for the electromechanical valve. In some embodiments, the method may further include mapping a minimum position in the range of positions of the manually-actuated user control to the minimum setting for the determined active range for the electromechanical valve.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present disclosure is provided in the following written description of various embodiments of the disclosure, illustrated in the accompanying drawings, and defined in the appended claims.

DETAILED DESCRIPTION

Figure 1:
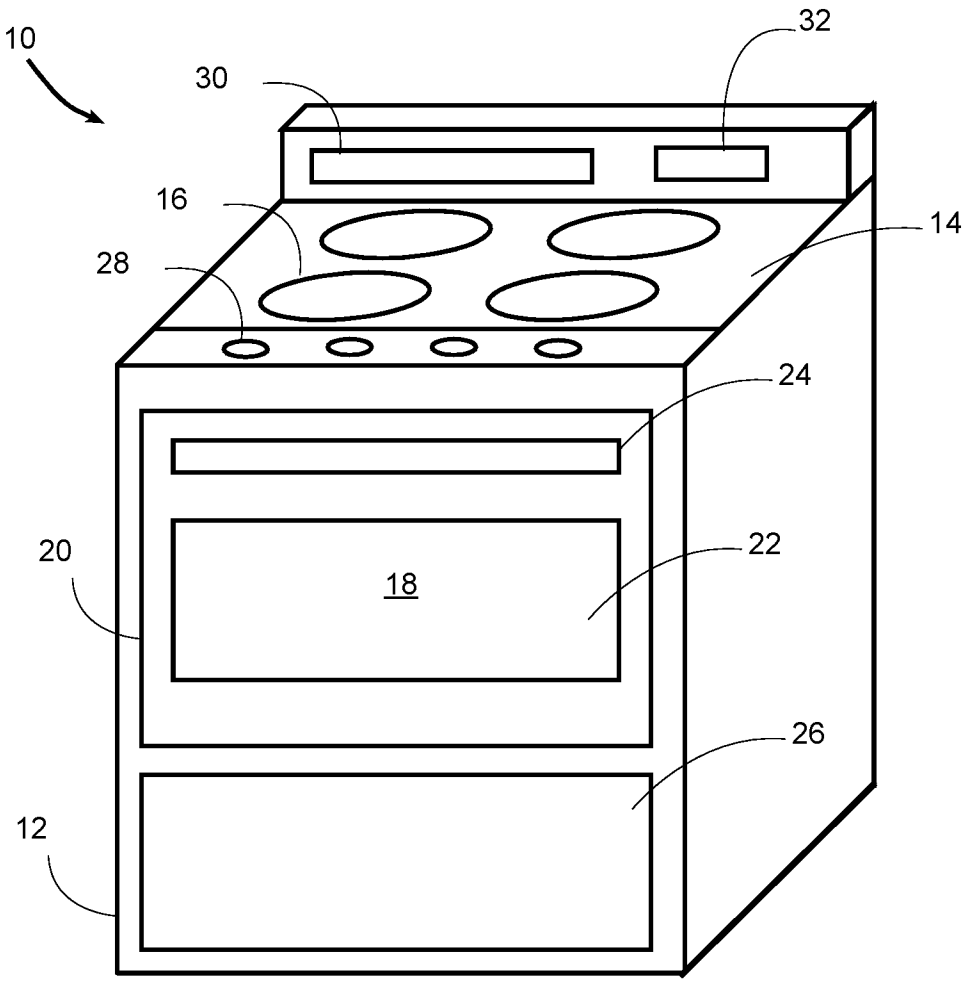
FIG. 1 is a perspective view of a gas cooking appliance, consistent with some embodiments of the disclosure.

It is to be understood that a gas cooking appliance with an active range adjusting ability is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to direct physical or mechanical connections or couplings. It should be noted that the adjusting mechanism could vary greatly and still accomplish the same intent.

The embodiments discussed hereinafter will, for convenience only, focus on the implementation of the hereinafter-described apparatus and techniques within a gas cooking appliance. As shown in the figures, the particular embodiment depicted shows a gas cooking appliance with a plurality of gas cooking elements, such as a plurality of cooktop burners and an oven. However, it will be appreciated that the apparatus and techniques may also be used in connection with other types of gas cooking appliances, and even with other types of gas equipment and/or systems. For example, the gas cooking appliance might have only one cooktop burner, might not include an oven, or might even be just an oven with no cooktop burners.

Turning now to the drawings, wherein like numbers denote like parts throughout the several views, FIG. 1 illustrates the gas cooking appliance 10 in which the various technologies and techniques described herein may be implemented. The cooking appliance 10 may be a residential-type range, and as such may include a housing 12, a stovetop or cooktop 14 including a plurality of gas cooking elements or burners 16, and an oven 18 defining a cooking cavity accessed via an oven door 20 having a window 22 and a handle 24. The cooking appliance 10 may also include a storage drawer 26 in some embodiments, or in other embodiments, may include a second oven. Various cooking elements (not shown in FIG. 1) may also be incorporated into the cooking appliance 10 for cooking food in the oven 18, e.g., one or more gas burners.

The cooking appliance 10 may also include a plurality of manually-actuated user controls, e.g., control knobs 28 for controlling the plurality of burners 16, and a control panel 30 for controlling oven 18 and/or the plurality of burners 16. It will be appreciated that the control knob 28 may include various types of manually-actuated user controls in other embodiments, including various combinations of switches, buttons, knobs and/or sliders, typically disposed at the rear or front (or both) of the cooking appliance. Further, in some embodiments, one or more touch screens may be employed for interaction with a user. In addition, in some embodiments, the control knob 28 may be touch sensitive to receive a user input via touching, and may be rotatable to control the heat or output level of the burner 16.

In some embodiments, the cooking appliance 10 may further include a user interface display 32 for providing visual feedback as to the activation status of the cooking appliance 10, such as a clock, cooking process status, cooking time, and/or the like. The user interface display 32 may also vary in different embodiments, and may include individual indicators, segmented alphanumeric displays, and/or dot matrix displays, and may be based on various types of display technologies, including LEDs, vacuum fluorescent displays, incandescent lights, etc. In some embodiments, the user interface display 32 may be a touch sensitive screen to receive the user input in addition to displaying status information and/or otherwise interact with a user. For example, the user interface display 32 may include a control selector for the user selection and/or for the certain function activation. In still other embodiments, the cooking appliance 10 may be controllable remotely, e.g., via a smartphone, tablet, personal digital assistant or other networked computing device, e.g., using a web interface or a dedicated app. Further, in some embodiments, the user input may be received via a spoken or gesture-based interface, and audio feedback may be provided to the user via one or more speakers. In some embodiments, the cooking appliance 10 may include a digital camera to receive a gesture by the user as the user input. In some other embodiments, the cooking appliance 10 may also include a microphone to receive a voice command by the user as the user input.

As noted above, the cooking appliance 10 of FIG. 1 may be a range, which combines a stovetop or cooktop with one or more ovens, and which in some embodiments may be a standalone or drop-in type of range. In other embodiments, however, the cooking appliance 10 may be another type of cooking appliance, e.g., a wall mount or freestanding oven, a drop-in stovetop or cooktop, etc. In general, a cooking appliance consistent with the disclosure may be considered to include any residential-type appliance including a housing and one or more gas cooking elements disposed thereon and/or therein and configured to generate energy for cooking food.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave heating elements in some embodiments, while in the case of a stovetop, one or more cooking elements therein may be gas, electric, or inductive heating elements in some embodiments. Further, it will be appreciated that any number of cooking elements may be provided in a cooking appliance, and that multiple types of cooking elements may be combined in some embodiments, e.g., combinations of microwave and light cooking elements in some oven embodiments.

Figure 2:
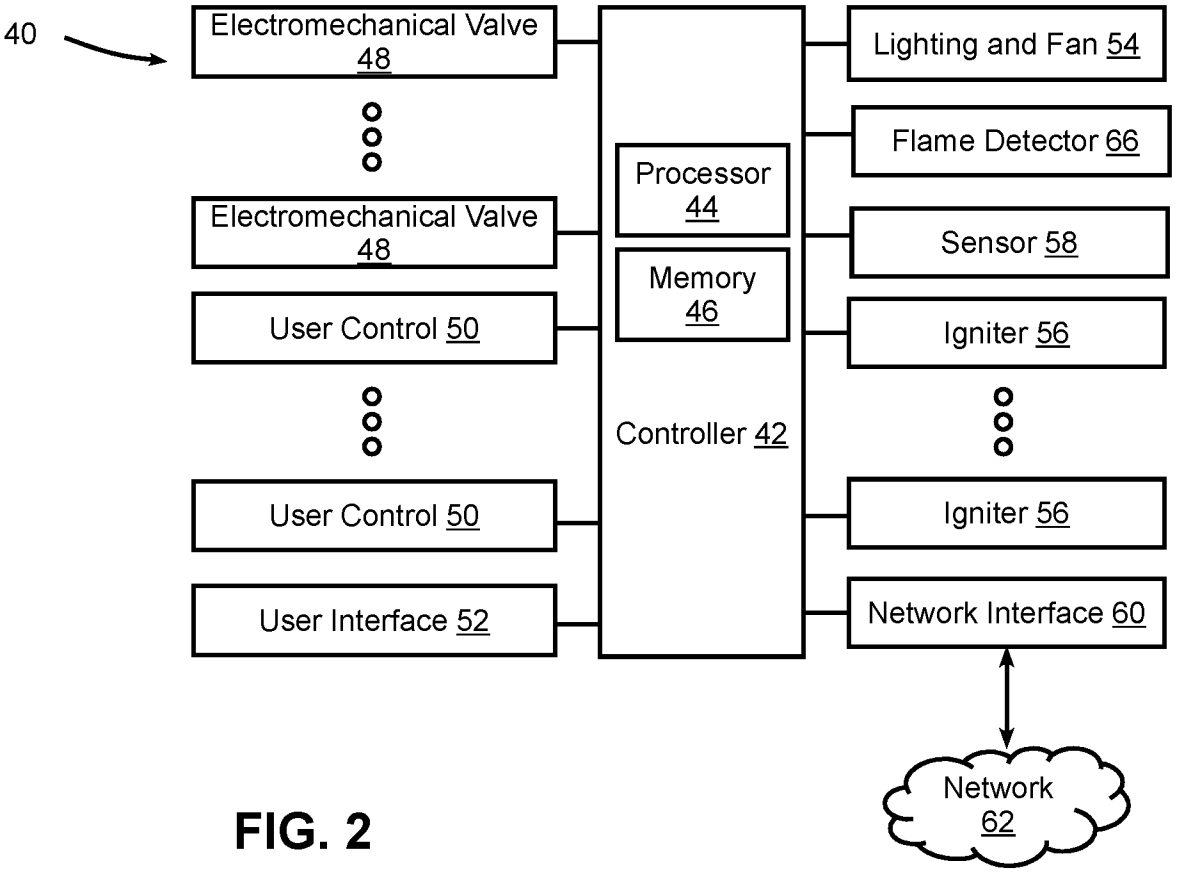
FIG. 2 is a block diagram of an example control system for a gas cooking appliance, consistent with some embodiments of the disclosure.

A cooking appliance consistent with the disclosure also generally includes one or more controllers configured to control the cooking elements and otherwise perform cooking operations at the direction of a user. FIG. 2, for example, illustrates an example of a gas cooking appliance control system 40 including a controller 42 that receives inputs from a number of components and drives a number of components in response thereto. The cooking appliance control system 40 may be implemented using practically any type of cooking appliance, e.g., a range, stovetop, single oven, double oven, wall oven, standalone oven, etc. The controller 42 may, for example, include one or more processors 44 and a memory 46 within which may be stored program code for execution by the one or more processors. The memory may be embedded in the controller 42, but may also be considered to include volatile and/or non-volatile memories, cache memories, flash memories, programmable read-only memories, read-only memories, etc., as well as memory storage physically located elsewhere from the controller 42, e.g., in a mass storage device or on a remote computer interfaced with the controller 42.

As shown in FIG. 2, the controller 42 may be interfaced with various components, including a plurality of non-gas cooking elements used for cooking food (e.g. burners, oven heating elements, and the like), a plurality of manually-actuated user controls 50 for receiving user input (e.g., various combinations of switches, knobs, buttons, sliders, touchscreens or touch-sensitive displays, microphones or audio input devices, image capture devices, etc.), and a user interface 52 (including various indicators, graphical displays, textual displays, speakers, touch screens, control selectors, etc.). Further, for any gas cooking elements (not shown in FIG. 2), a plurality of electromechanical valves 48 may be provided to regulate the gas flow rate to such gas cooking elements, and one or more flame detectors 66 may be provided to detect the presence of a flame in the gas cooking elements. Controller 42 may also be interfaced with various additional components suitable for use in a cooking appliance, e.g., one or more lights and/or one or more fans 54 (e.g., an oven light, a cooktop light, a convection fan, cooling fan, etc.), among others. It will be appreciated, for example, that the controller 42 may be interfaced with each electromechanical valve 48 and one or more igniters 56 to ignite gas supplied to the gas cooking elements.

In some embodiments, the controller 42 may also be interfaced with various sensors 58 located to sense environmental conditions inside of and/or external to the cooking appliance control system 40, e.g., one or more pressure sensors, temperature sensors, humidity sensors, air quality sensors, smoke sensors, carbon monoxide sensors, odor sensors and/or electronic nose sensors, among others. Such sensors may be internal or external to the cooking appliance control system 40, and may be coupled wirelessly to the controller 42 in some embodiments.

In some embodiments, the controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. The network 62 may incorporate in some embodiments a home automation network, and various communication protocols may be supported, including various types of home automation communication protocols. In other embodiments, other wireless protocols, e.g., Wi-Fi or Bluetooth, may be used.

In some embodiments, the cooking appliance control system 40 may be interfaced with one or more user devices over network 62, e.g., computers, tablets, smart phones, wearable devices, etc., and through which cooking appliance control system 40 may be controlled and/or cooking appliance control system 40 may provide user feedback.

In some embodiments, the controller 42 may operate under the control of an operating system and may execute or otherwise rely upon various computer software applications, components, programs, objects, modules, data structures, etc. In addition, the controller 42 may also incorporate hardware logic to implement some or all of the functionality disclosed herein. Further, in some embodiments, the sequences of operations performed by the controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliance 10 and the cooking appliance control system 40 illustrated in FIGS. 1 and 2 will be apparent to one of ordinary skill in the art, as will become apparent from the description herein. Therefore, the disclosure is not limited to the specific implementations discussed herein.

It will be appreciated that variable gas control valves (e.g., electromechanical valves) are generally used to enable a user to vary the gas flow rate and thereby control the heating output of a gas cooking element. During operation, the gas control valve may be adjusted between a minimum setting and a maximum setting. With a mechanical gas control valve that is actuated by a mechanically-coupled control knob, for example, turning the knob from one end of its range to the other end of its range generally results in the gas control valve increasing from a fully-closed position to a maximum flow position within an ignition range during which an ignitor is activated, maintaining the maximum flow position to enable the gas cooking element to operate at a maximum output level, and then tapering back down to a minimum flow position representing a minimum output level for the gas cooking element. With an electromechanical valve controlled based upon the position of an electrically-coupled control knob, a similar operation may occur, or alternatively, rotation of the knob may simply transition the electromechanical valve between minimum and maximum settings, with a separate control used to trigger ignition. Regardless, it should be appreciated that if the minimum setting of a gas control valve does not provide sufficient gas flow to maintain a flame, a risk exists that the flame may be extinguished when the gas control valve is set at the minimum setting. Therefore, it is generally desirable to configure the minimum setting of a gas control valve to one that is capable of maintaining a flame. However, it will also be appreciated that the minimum gas flow that may be required to maintain a flame for a particular gas cooking element may be influenced by various factors, including, for example, the pressure of the gas supply, the size and/or type of the gas cooking element, the operating states of other gas cooking elements, and the type of gas (e.g., propane or natural gas). In order to ensure that the minimum setting is capable of addressing all of these different factors, an overly-conservative minimum setting may be used. On the other hand, increasing a minimum setting generally reduces the operating range of a gas cooking element, thereby restricting the range of output levels that can be selected by a user when using a particular gas cooking element.

The present disclosure, on the other hand, is directed to a control system has the ability to initiate a calibration process for adjusting an active range of a gas cooking appliance, and specifically, for tailoring an active range of a particular gas cooking element to optimize the active range of that gas cooking element based upon the particular conditions associated with that gas cooking element. An active range may be considered to include at least a configurable minimum setting, and in some embodiments, an active range may also include a configurable maximum setting. As will also become more apparent below, an active range may be used to control a gas control valve to remain between the minimum and maximum settings so that the gas cooking element is always capable of maintaining a flame whenever the gas cooking element is active, so a user may adjust the heat output of the gas cooking element within the corresponding active range. Further, in some embodiments, an active range may be used to customize a mapping between a manually-actuated user control and an electromechanical valve to optimize the mapping to provide finer-grained control over the output level of a gas cooking element.

Figure 3:
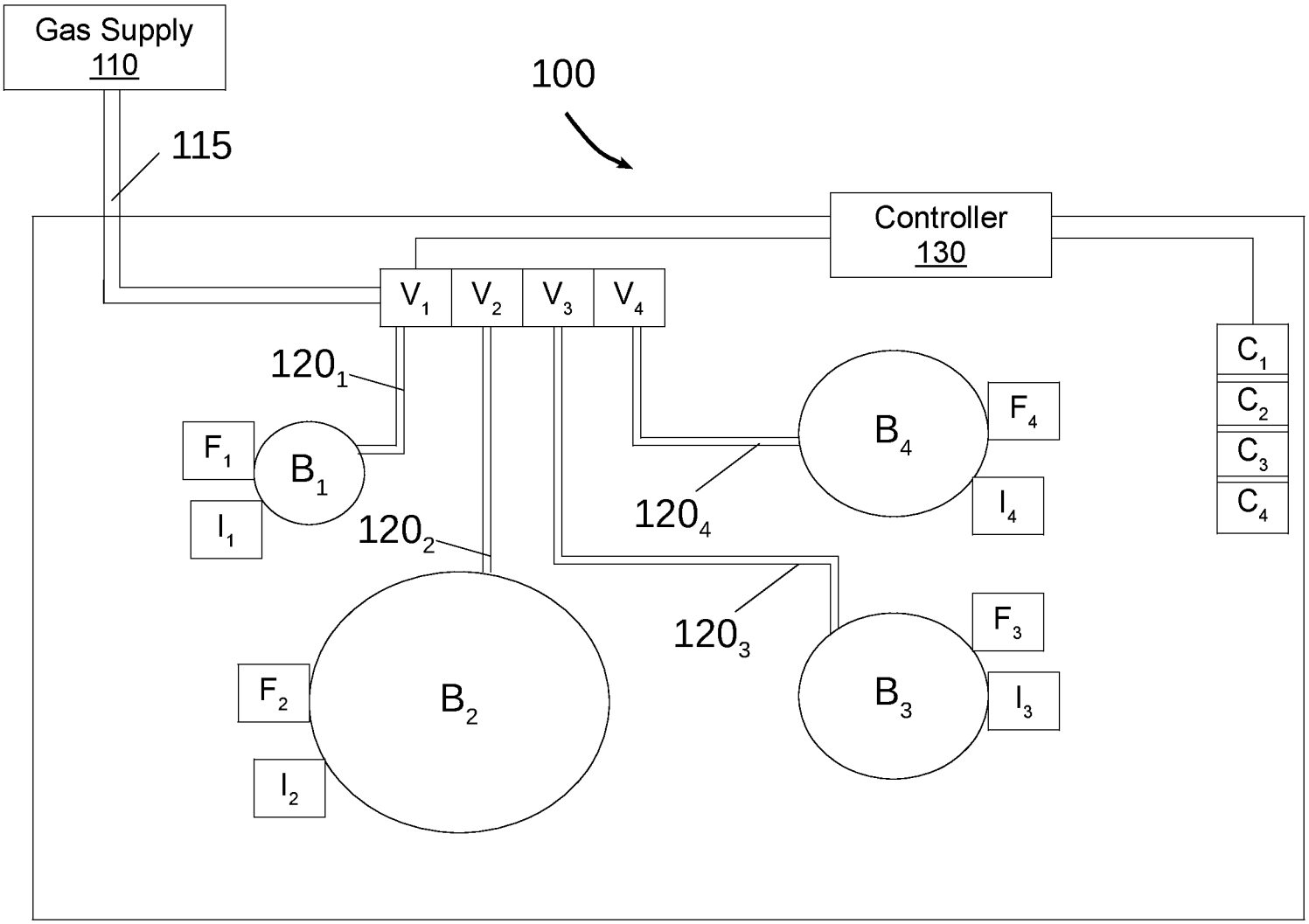
FIG. 3 is a control system for controlling a cooktop of the gas cooking appliance of FIG. 1, consistent with some embodiments of the disclosure.

To better illustrate how the calibration process of adjusting a gas cooking appliance active range works, an embodiment of a cooktop control system 100 is illustrated in FIG. 3. A gas supply 110 may be fed into one or more electromechanical valves $V_1$, $V_2$, $V_3$, and $V_4$, through a main gas piping or tubing line 115, or the like. In some embodiments, each electromechanical valve $V_1$, $V_2$, $V_3$, and $V_4$ may further include a stepper motor, which divides a full rotation of the valve into a number of equal steps, allowing for fine adjustment of the electromechanical valve. In some embodiments, the stepper motor may be a 400 step motor, but this is not to be understood as limiting, as the number of steps may vary. In some embodiments, such as illustrated, there may be four electromechanical valves $V_1$, $V_2$, $V_3$, and $V_4$; in other embodiments, the number of valves may vary. The number, capacity, and/or the arrangement of the electromechanical valves are not intended to be limiting, as a person of ordinary skill in the art would recognize these may vary based on user desire, costs, design aesthetics, or any number of other considerations.

As illustrated in FIG. 3, the cooktop control system 100 may include a plurality of burners $B_1$, $B_2$, $B_3$, and $B_4$, and each of the burners $B_1$, $B_2$, $B_3$, and $B_4$ may be fluidly coupled to the plurality of electromechanical valves $V_1$, $V_2$, $V_3$, and $V_4$ respectively, where the electromechanical valves $V_1$, $V_2$, $V_3$, and $V_4$ are configured to regulate the gas flow rate to each of the burners $B_1$, $B_2$, $B_3$, and $B_4$. This fluid coupling may be through the use of gas piping or tubing $\mathbf{120}_{1\text{-}4}$, or the like, running between each valve $V_1$, $V_2$, $V_3$, and $V_4$ and each burner $B_1$, $B_2$, $B_3$, and $B_4$. The burners $B_1$, $B_2$, $B_3$, and $B_4$ may have different output capacities, as illustrated by their relative sizes. For example, the burner $B_1$ may be a small capacity burner, burners $B_3$ and $B_4$ may be medium capacity burners, and burner $B_2$ may be a large capacity burner. In some embodiments, the cooktop may contain a varying number of burners, for example, some cooktops may only contain one or two burners, while other cooktops may contain six or more burners. In other embodiments, the burners of the cooktop may vary in size or output capacity, for example some cooktops may contain burners of identical capacity, while other cooktops may contain only two different capacity burners. In still other embodiments, the arrangement of the burners may also vary from the illustration of FIG. 3. The number, capacity, and/or the arrangement of the burners are not intended to be limiting, as a person of ordinary skill in the art would recognize these may vary based on user desire, costs, design aesthetics, or any number of other considerations.

The cooktop control system 100 may further include a plurality of manually-actuated user controls $C_1$, $C_2$, $C_3$, and $C_4$, each of which may be movable over a range of positions. Such a range of positions may include only a portion of the full range of positions of a control in some embodiments. For example, in some embodiments, the manually-actuated user control may be a control knob. In some embodiments, such a control knob may be capable of a full 360 degrees rotation; in other embodiments, the control knob may only rotate over a portion or subset of the possible positions. In other embodiments, the manually-actuated user control may be a slider that slides over the range of positions, or various other types of variable controls capable of outputting a variable control signal within a range of values.

The cooktop control system 100 may additionally include a controller 130 that is coupled to each of the manually-actuated user controls $C_1$, $C_2$, $C_3$, and $C_4$, and to each of the electromechanical valves $V_1$, $V_2$, $V_3$, and $V_4$. This coupling may be wired, as illustrated in FIG. 3, or may be wireless. The controller 130 may be configured to determine what position each of the manually-actuated user controls $C_1$, $C_2$, $C_3$, and $C_4$ is in, within all possible positions. For example, the controller 130 may determine that the burner $B_1$ is off, the burner $B_2$ is on and turned 180 degrees, the burner $B_3$ is off, and the burner $B_4$ is on and turned 210 degrees. The controller 130 may control each electromechanical valve $V_1$, $V_2$, $V_3$, and $V_4$ based on the determined position of each of the manually-actuated user controls $C_1$, $C_2$, $C_3$, and $C_4$. The controller 130 may control each of the electromechanical valves $V_1$, $V_2$, $V_3$, and $V_4$ so as to provide a controlled relationship between the gas flow from the valves $V_1$, $V_2$, $V_3$, and $V_4$ to the each of the burners $B_1$, $B_2$, $B_3$, and $B_4$ and the position of each the manually-actuated user controls $C_1$, $C_2$, $C_3$, and $C_4$. It will be appreciated that in these embodiments, each valve $V_1$, $V_2$, $V_3$, and $V_4$ is controlled based upon the position of the respective corresponding user control $C_1$, $C_2$, $C_3$, and $C_4$, and as such, each valve may be controlled independently of the state of any other valve in the cooking appliance 10. In other embodiments, however, the state of each of the electromechanical valves $V_1$, $V_2$, $V_3$, and $V_4$ may be used as an input to control the state of another valve, e.g., to effectively adjust the position of the electromechanical valve $V_1$ based upon the state of electromechanical valves $V_2$, $V_3$, and/or $V_4$. Moreover, in some embodiments, only a subset of the cooking elements in a cooking appliance may be controlled in the herein-described manner, with other cooking elements controlled in a different manner.

In some embodiments, it may be desirable to provide a calibration process that can automatically adjust the active ranges for the burners $B_1$, $B_2$, $B_3$, and $B_4$ through electronic control. Such auto-adjusting of the active ranges may even enable the cooking appliance 10 to omit additional hardware (e.g., an adjustable orifice or a replaceable orifice, etc.) to support different gas types (e.g., natural gas or propane). In some embodiments, the controller 130 may perform the calibration process in real-time in response to a measurement and/or detection of the operation status of the cooking appliance 10, such as the flame detection described herein, or any other information that may be available to the controller 130. To realize the flame detection, the cooktop control system 100 may include one or more flame detectors $F_1$, $F_2$, $F_3$, and $F_4$ to detect a flame state in the one or more of the burners $B_1$, $B_2$, $B_3$, and $B_4$, as additional inputs for controlling the electromechanical valves $V_1$, $V_2$, $V_3$, and $V_4$. Each flame detector may be a sensor designed to detect and respond to the presence of a flame or fire. In some embodiments, the flame detector may include an infrared camera, infrared thermometer, thermal imaging camera, ultraviolet flame detector, flame ionization spectrometer, pyrometer, thermocouple, or flame sense rod. It will be appreciated that various technologies may be used for monitoring the flame, and the number and the location of the flame detectors $F_1$, $F_2$, $F_3$, and $F_4$ are not limited. In some embodiments, such as illustrated in FIG. 3, the number of the flame detectors $F_1$, $F_2$, $F_3$, and $F_4$ may correspond to the number of burners $B_1$, $B_2$, $B_3$, and $B_4$; however, in other embodiments, the number of the flame detectors $F_1$, $F_2$, $F_3$, and $F_4$ may vary. For example, there may be only one flame detector for detecting the presence of a flame for all the burners $B_1$, $B_2$, $B_3$, and $B_4$ simultaneously. Furthermore, although illustrated as positioned adjacent the burners $B_1$, $B_2$, $B_3$, and $B_4$ in FIG. 3, this is not intended to be limiting, as the one or more flame detectors $F_1$, $F_2$, $F_3$, and $F_4$ may be positioned anywhere feasible for flame detection in the cooking appliance 10. In some embodiments, if one or more flame loss conditions are detected based on signals from the one or more flame detectors $F_1$, $F_2$, $F_3$, and $F_4$, the controller 130 may be further configured to activate a corrective action. In some embodiments, this corrective action may be in the form of some types of an alarm to alert the one or more flame loss conditions to the user through a visual, audio, message, or any other type of suitable alarm and/or may be configured to automatically shut off the gas supply 110 to the cooking appliance 10 (e.g., by controlling a master valve located on the main gas piping line 115). In other embodiments, the corrective action may be to attempt to re-ignite the burner, e.g., by activating one or more igniters $I_1$, $I_2$, $I_3$, and $I_4$ and/or controlling the electromechanical valves $V_1$, $V_2$, $V_3$, and $V_4$ (including, in some embodiments, after shutting off the valve for some period of time to allow any unburnt gas to disperse in the environment).

The aforementioned calibration process may be realized through the use of the cooktop control system 100 of FIG. 3, but this is not intended to be limiting, and the calibration process may be used by different types of gas systems. In some embodiments, the controller 130 may be configured to initiate the calibration process to determine an accurate active range for the burner $B_1$. For the calibration process, the burner $B_1$ may be ignited by an igniter $I_1$ after the manually-actuated user control $C_1$ is turned on to direct the gas supply 110 to the burner $B_1$. Then the controller 130 may be configured to control the electromechanical valve $V_1$ to reduce the gas flow rate to the burner $B_1$ to start the calibration process. With the electromechanical valve $V_1$ gradually closing, the gas flow rate reduction may finally reach a point at which the flame of the burner $B_1$ is extinguished. This occurrence may be sensed by the flame detector such as a thermocouple, and a corresponding signal may be sent to the controller 130 to enable the controller 130 to determine the corresponding minimum position of the electromechanical valve $V_1$ correspondingly. In some embodiments, the determined minimum position of the electromechanical valve $V_1$ may be memorized in the memory of the controller 130 as indicated in FIG. 2. The minimum positions of the electromechanical valves $V_2$, $V_3$, and $V_4$ for the burners $B_2$, $B_3$, and $B_4$ may be calibrated and determined in a similar manner.

In some embodiments, the controller 130 may be further configured to add a predetermined value to the determined minimum position of the electromechanical valve $V_1$ to establish a minimum setting for the active range of the burner $B_1$. This predetermined value may be a manufacturer preset value, or the user may adjust this predetermined value, for example, adjust through a user interface per the user's preference. The minimum settings of the electromechanical valves $V_2$, $V_3$, and $V_4$ for the burners $B_2$, $B_3$, and $B_4$ may be calibrated and determined in a similar manner.

The maximum setting for an active range is generally limited by the maximum flow rate supported by the cooking appliance due to the machining of the cooking appliance components (e.g., the type and/or the size of valves, cooking elements, piping lines, etc.). Accordingly, in some embodiments, the controller 130 may be further configured to determine a maximum setting for the active range of the burner $B_1$ based on the size of the burner $B_1$, the type of the burner $B_1$, the size of the electromechanical valve $V_1$, the type of electromechanical valve $V_1$, and/or the type of gas being supplied to the burner $B_1$ (e.g. natural gas, propane, or the like). The maximum settings of the electromechanical valves $V_2$, $V_3$, and $V_4$ for the burners $B_2$, $B_3$, and $B_4$ may be calibrated and determined in a similar manner. In other embodiments, the maximum setting for the active range may simply be set as the maximum position for the valve (e.g., a 100% valve open position). In summary, an accurate active range with a minimum setting and a maximum setting for each burner $B_1$, $B_2$, $B_3$, and $B_4$ may be calibrated and determined with the calibration process such that control over the associated valve is restricted to the positions within this range. In some embodiments, the minimum/maximum setting may be a minimum/maximum value of a flow rate, valve open position, control knob rotation, or the like.

Figure 4A:
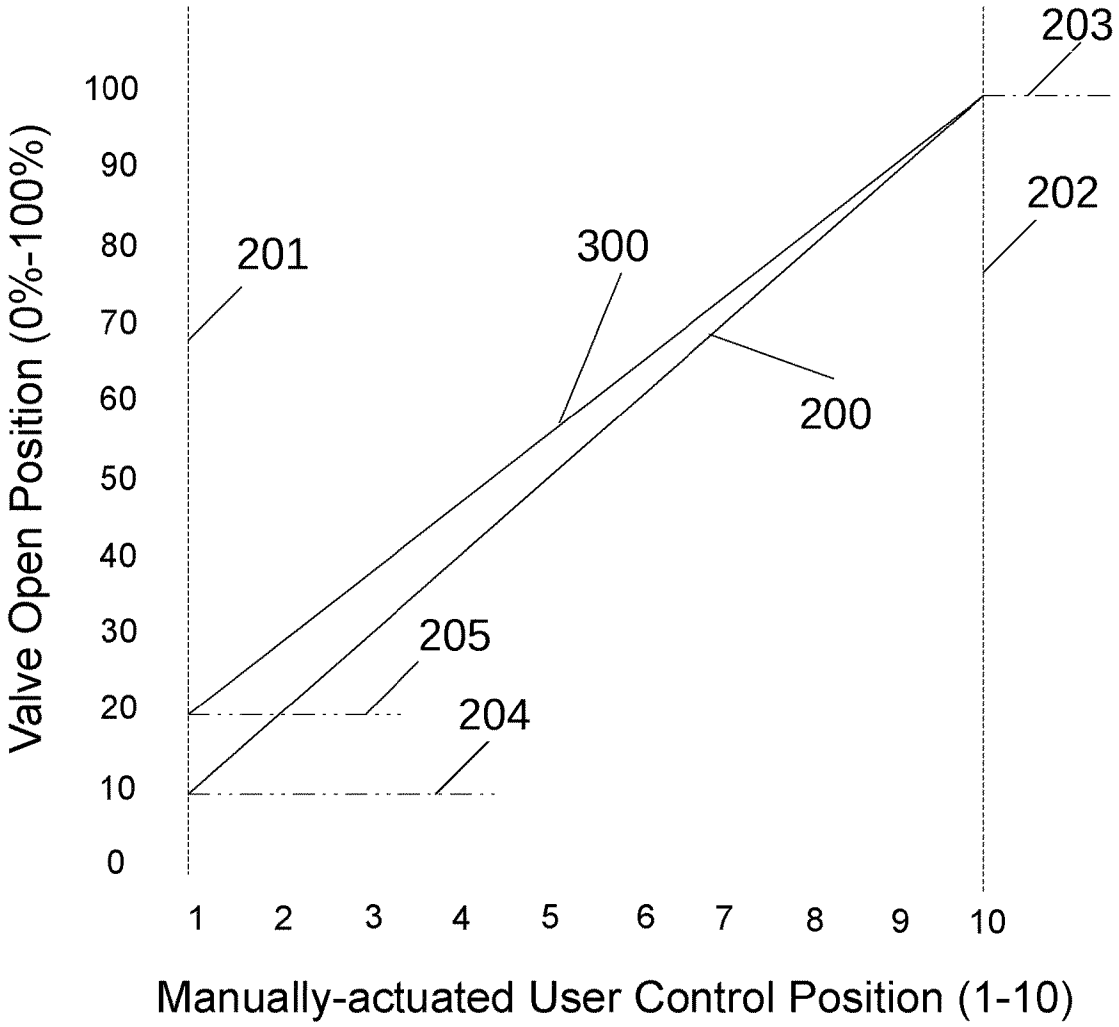
FIG. 4A is a graph of curves for a gas valve to illustrate an active range adjusting approach, consistent with some embodiments of the disclosure.
Figure 4B:
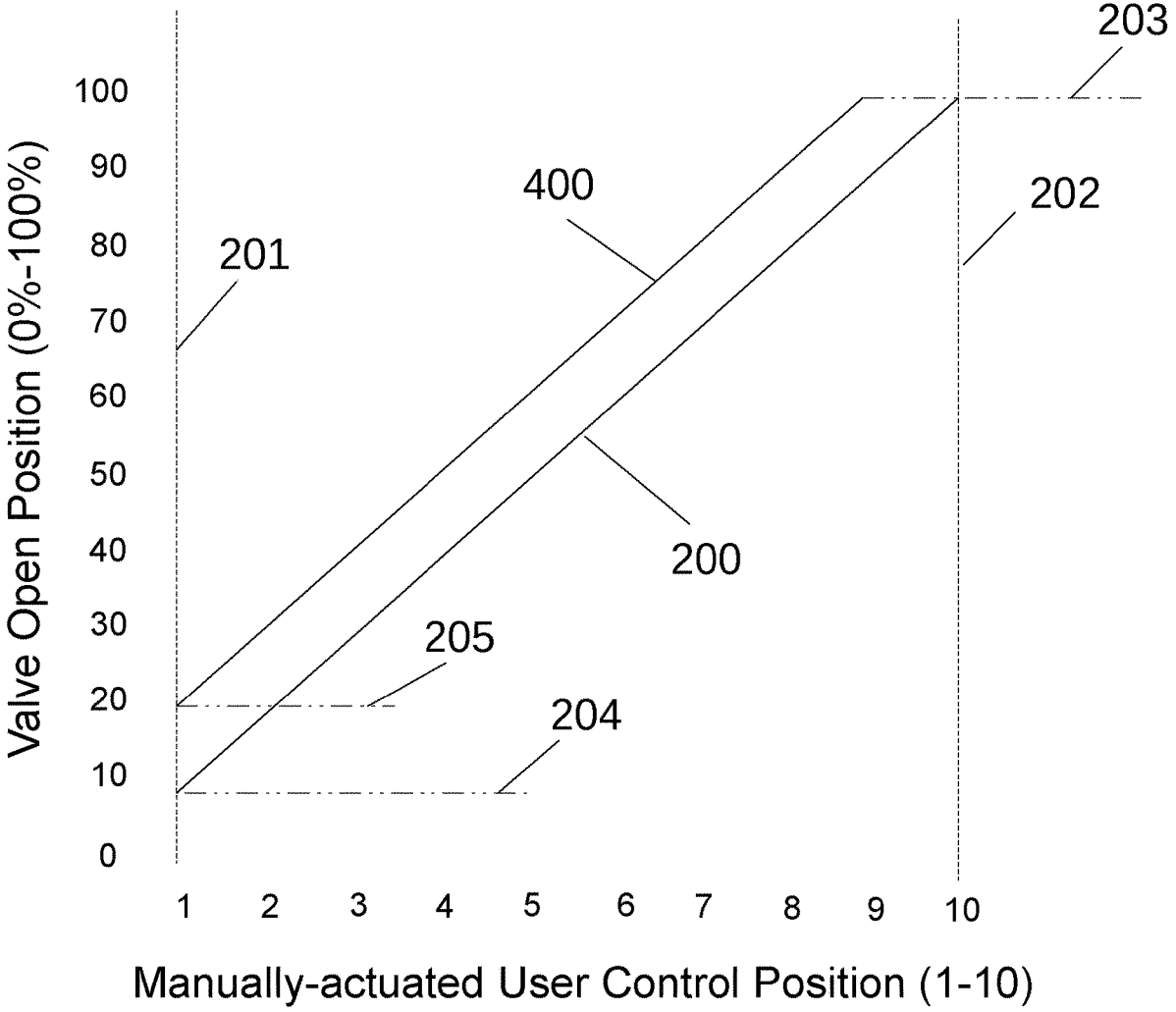
FIG. 4B is a graph of curves for a gas valve to illustrate another active range adjusting approach, consistent with some embodiments of the disclosure.

In some embodiments, the controller 130 may use the determined active range in the control of the electromechanical valves by mapping a relationship between the positions of the manually-actuated user controls and the corresponding positions of the electromechanical valves. In some embodiments, this mapping may be through the use of a curve (as illustrated in FIGS. 4A and 4B). In other embodiments, the mapping may be through the use of a table or a chart (as illustrated in Table 1). In still other embodiments, the mapping may be through the use of an algorithm or function to calculate the necessary components of the desired controlled relationship. These embodiments are not intended to be limiting. For example, after the active range for each of the electromechanical valves $V_1$, $V_2$, $V_3$, and $V_4$ is calibrated and determined through the calibration process, the controller 130 may be further configured to map the range of positions of each of the manually-actuated user controls $C_1$, $C_2$, $C_3$, and $C_4$ to the determined active range for each of the electromechanical valves $V_1$, $V_2$, $V_3$, and $V_4$. This may allow for real-time adjustments of the positions of the electromechanical valves $V_1$, $V_2$, $V_3$, and $V_4$ over the entire range of the manually-actuated user controls $C_1$, $C_2$, $C_3$, and $C_4$. When the flame remains alight, the controller 130 may access one or more mappings in order to determine a setting for each of the electromechanical valves $V_1$, $V_2$, $V_3$, and $V_4$ based on the positions of the one or more manually-actuated user controls $C_1$, $C_2$, $C_3$, and $C_4$. In some embodiments, it may be desirable for an electromechanical valve to flow at about X % of capacity when a user, for example, turns a manually-actuated knob about X % of the range from the minimum setting to the maximum setting. As such, it may be desirable to map a controlled relationship (e.g. a substantially linear relationship) between varying positions of the manually-actuated user controls, such as knobs, and the settings for the valves. FIGS. 4A, 4B, and Table 1 illustrate the mapping relationship to be in a substantially linear form to better illustrate these embodiments, but this is not intended to be limiting as other forms of mapping relationships may also be used.

Also, since there is no mechanical coupling between the manually-actuated user controls and the electromechanical valves, it may be desirable, in some embodiments, to adjust the mapping relationship between the manually-actuated user controls and the electromechanical valves to maximize and/or optimize the range of positions for the manually-actuated user controls so that the minimum and maximum extents of control positions correspond to the determined active range of the electromechanical valves, thus providing a finer-grained control over the output level of the gas cooking element. FIGS. 4A and 4B are used here to better illustrate how a mapping adjusting process works. An original curve 200 as illustrated in FIGS. 4A and 4B may represent a mapping relationship of a range of positions of the manually-actuated user control $C_1$ with respect to an active range for the electromechanical valve $V_1$ before a calibration process. In some embodiments, there may be ten total positions for the manually-actuated user control $C_1$, which may be, in some embodiments, displayed on the manually-actuated user control itself. Although the manually-actuated user control position shown here is between one and ten, this is not intended to be limiting, and the manually-actuated user control setting may include more or less settings and/or may alternatively be in the form of percentages or other markers (e.g. "high," "medium," and "low"). In addition, rather than defining the manually-actuated user control positions based upon arbitrary labels, the control knob positions may be based on rotational position in some embodiments, or, for example, where a control knob drives a potentiometer, a voltage or current, or practically any other control signal that varies over a range of positions of a control.

In some embodiments, for example, it may be determined from the aforementioned calibration process, or alternatively prior to any calibration process as a result of a default value determined by a manufacturer, that that for the particular valve $V_1$ when coupled to the particular burner $B_1$ with a particular gas supply that a flame can remain alight at a minimum setting of 10% valve open position. As such, the initial active range for the electromechanical valve $V_1$ may have a minimum setting of 10% valve open position and a maximum setting of 100% valve open position (on a scale from 0% to 100%).

Referring back to FIGS. 4A and 4B, the minimum position (position 1) of the range of positions of the manually-actuated user control $C_1$ may be represented by a first vertical line 201, and the maximum position (position 10) of the range of positions of the manually-actuated user control $C_1$ may be represented by a second vertical line 202. For example, approximately 90 degrees rotation of a control knob may effectively define the minimum position 1 of the control knob, while approximately 270 degrees of rotation may effectively defines the maximum position 10 of the control knob. The maximum setting of the determined active range for the electromechanical valve which is when the electromechanical valve $V_1$ 100% open here, may be represented by a first horizontal line 203, while the minimum setting (10% open) may be represented by a second horizontal line 204. In some embodiments, the controller 130 may be configured to map the minimum position in the range of positions of the manually-actuated user control $C_1$ (represented by the first vertical line 201) corresponding to the minimum setting for the determined active range for the electromechanical valve $V_1$ (represented by second horizontal line 204). In some embodiments, the controller 130 may be configured to map the maximum position in the range of positions of the first manually-actuated user control $C_1$ (represented by the second vertical line 202) corresponding to the maximum setting for the determined active range for the electromechanical valve $V_1$ (represented by the first horizontal line 203).

A first adjusting curve 300 and a second adjusting curve 400 as shown in FIGS. 4A and 4B may illustrate two example approaches for adjusting the mapping of positions of the manually-actuated user control $C_1$ to the determined active range for the electromechanical valve $V_1$ with a new minimum setting being determined through the calibration process. For example, the calibration process may be initiated with the gas supply 110 for the burner $B_1$ conversing from propane to natural gas. As natural gas has a lower heating value than propane, the original minimum setting (10% open) for the electromechanical valve $V_1$ may not be able to keep the flame alight. After conducting the automatic calibration process as discussed above, the minimum setting for the electromechanical valve $V_1$ may become a 19% valve open position, because the burner $B_1$ needs a higher flow rate of natural gas than propane to keep the flame alight. Accordingly, the new determined minimum setting (19% open) for the electromechanical valve $V_1$ may be represented by a third horizontal line 205. After the calibration process, the mapping relationship of the range of positions of the manually-actuated user control $C_1$ with respect to the active range for the electromechanical valve $V_1$ may be re-mapped based on the new determined minimum setting (19% open) to provide the control transitions desired.

In some embodiments, the controller 130 may be configured to map of positions of the manually-actuated user control $C_1$ to the determined active range for the electromechanical valve $V_1$ by applying a scaling factor (i.e., the active range for the valve may be re-scaled to match). As illustrated in FIG. 4A, as the maximum setting is usually fixed by the gas type and the gas cooking appliance components being used as discussed previously, the maximum setting for the electromechanical valve $V_1$ may stay the same (100% open) after the calibration process, while the minimum setting for the electromechanical valve $V_1$ may be adjusted to 19% valve open position from originally 10%. With the original curve 200 in the substantially linear form, those original positions might be 10%, 20%, 30%, 40%, 50%, 60%, 70%, 80%, 90%, and 100% in correspondence to positions 1 to 10 of the manually-actuated user control $C_1$. After the calibration process, as the minimum setting becomes 19%, the first adjusting curve 300 may be re-ramped with positions a 19%, 28%, 37%, 46%, 55%, 64%, 73%, 82%, 91%7 and 100% in correspondence to positions 1 to 10 of the manually-actuated user control $C_1$. As illustrated in FIG. 4A, the first adjusting curve 300 using this scaling factor adjusting approach has a smaller slope ratio compared with the original curve 200, so the heat output may decrease less rapidly from the maximum value to the minimum value after the adjustment.

In other embodiments, the controller 130 may be configured to map of positions of the manually-actuated user control $C_1$ to the determined active range for the electromechanical valve $V_1$ by applying a constant offset (i.e., shifting the entire curve with a constant offset). As illustrated in FIG. 4B, the second adjusting curve 400 may by created by shifting the entire original curve 200 upwards from the minimum 10% valve open position to 19%. As the second adjusting curve 400 has the same slope ratio with the original curve 200, the heat output may decrease with a same ratio from the maximum value to the minimum value after the adjustment. At the left end of the graph, e.g., between positions 9 and 10 of the user control, the valve position may remain constant, at the 100% value.

Another non-limiting example of mapping of the relationship between various positions of one of the manually-actuated user control $C_1$ to the determined active range for the electromechanical valve $V_1$ may be as illustrated in Table 1 below. Table 1 provides a mapping of the relationship between the ten positions (1-10) of manually-actuated user control $C_1$ and the corresponding open positions (0%-100%) of the valve $V_1$ for the Bruner $B_1$, along with two scenarios using the two different mapping adjustment approaches as illustrated in FIGS. 4A and 4B.

TABLE 1

| Manually-actuated User Control Position | Original Valve Position Setting (%) | New Valve Position Setting (%) using scaling factor adjusting method | New Valve Position Setting (%) using constant offset adjusting method |
|---|---|---|---|
| 1 | 10 | 19 | 19 |
| 2 | 20 | 28 | 29 |
| 3 | 30 | 37 | 39 |
| 4 | 40 | 46 | 49 |
| 5 | 50 | 55 | 59 |
| 6 | 60 | 64 | 69 |
| 7 | 70 | 73 | 79 |
| 8 | 80 | 82 | 89 |
| 9 | 90 | 91 | 100 |
| 10 | 100 | 100 | 100 |

The calibration process for determining the active range for the burner $B_1$ as discussed above may be performed with different output level combinations for the rest of the burners $B_2$, $B_3$, and $B_4$, as it will be appreciated that the gas flow to other burners may, in some embodiments, affect the rate of gas flow to a particular burner, and thus the valve position corresponding to the minimum setting for the active range. Therefore, in some embodiments, the controller 130 may be configured to control each of the burners $B_2$, $B_3$, and $B_4$ to operate at a maximum output level when determining the active range for the burner $B_1$. In some embodiments, the controller 130 may be configured to deactivate each of the burners $B_2$, $B_3$, and $B_4$ when determining the active range for the burner $B_1$. In some embodiments, it may even be desirable for the controller 130 to operate each of the burners $B_2$, $B_3$, and $B_4$ at each of a plurality of output levels when determining the active range for the burner $B_1$. It is understood that the calibration process for determining the active range for each of the burners $B_2$, $B_3$, and $B_4$ may be performed in a similar manner.

In some embodiments, for example, an active range for a burner, and the corresponding mapping between the manually-actuated user control and electromechanical valve therefor, may be determined as functions of the states (e.g., on or off, or alternatively particular valve positions) of the other burners. Thus, for example, in some instances, the minimum setting for a valve (and thus the active range) may be determined as a function of the positions of the other valves in the appliance (e.g., $V_{1,MIN}=f(V_2, V_3, V_4)$) as determined from calibration, and the mapping used between the valve and its associated manually-actuated user control may be adjusted accordingly based upon the current active range or minimum setting as determined based upon the valve positions of the other burners (i.e., the range of positions of the manually-actuated user control may be remapped to the active range for the valve based upon a change in state of one or more other valves). Further, in some instances, a change in the valve position for one burner may adjust the mappings for the other burners, as well as result in the valve positions of one or more other burners being dynamically adjusted to correspond to the new mapping, so that, for example, if a first burner is currently set at its minimum setting and a second burner is turned on such that the minimum setting for the first burner increases due to the overall increase in demand for gas, the valve position for the first burner may be dynamically adjusted to adapt to the increased minimum setting, thereby reducing the risk that the flame is extinguished as a result of turning on the second burner.

In some embodiments, the controller 130 may be configured to initiate the calibration process and/or repeat the calibration process in various conditions related to an installation, conversion, or other variation situations, which may otherwise affect the minimum setting of the active range. In some embodiments, the automatic calibration process may be executed upon initial setup of the cooking appliance 10, after conversion of the cooking appliance 10 to use a different type of gas, or on demand by a user or service technician.

In some embodiments, the cooktop control system 100 may further include a user interface 52 or a user interface display 32 coupled to the controller 130 as discussed previously, and the controller 130 may be configured to suggest performance of the calibration process to the user via the user interface 52 or the user interface display 32. In some embodiments, if the one or more flame detectors $F_1$, $F_2$, $F_3$, and $F_4$ detect one or more flame loss conditions, the controller 130 may be configured to suggest performance of the calibration process to the user via the user interface 52 (e.g., an external device such as a smart phone) or the user interface display 32 in response to the one or more flame loss conditions. In some embodiments, the controller 130 may also be configured to override the determined active range and/or to request different maximum/minimum settings than the determination produced by the calibration process, if desired.

Figure 5:
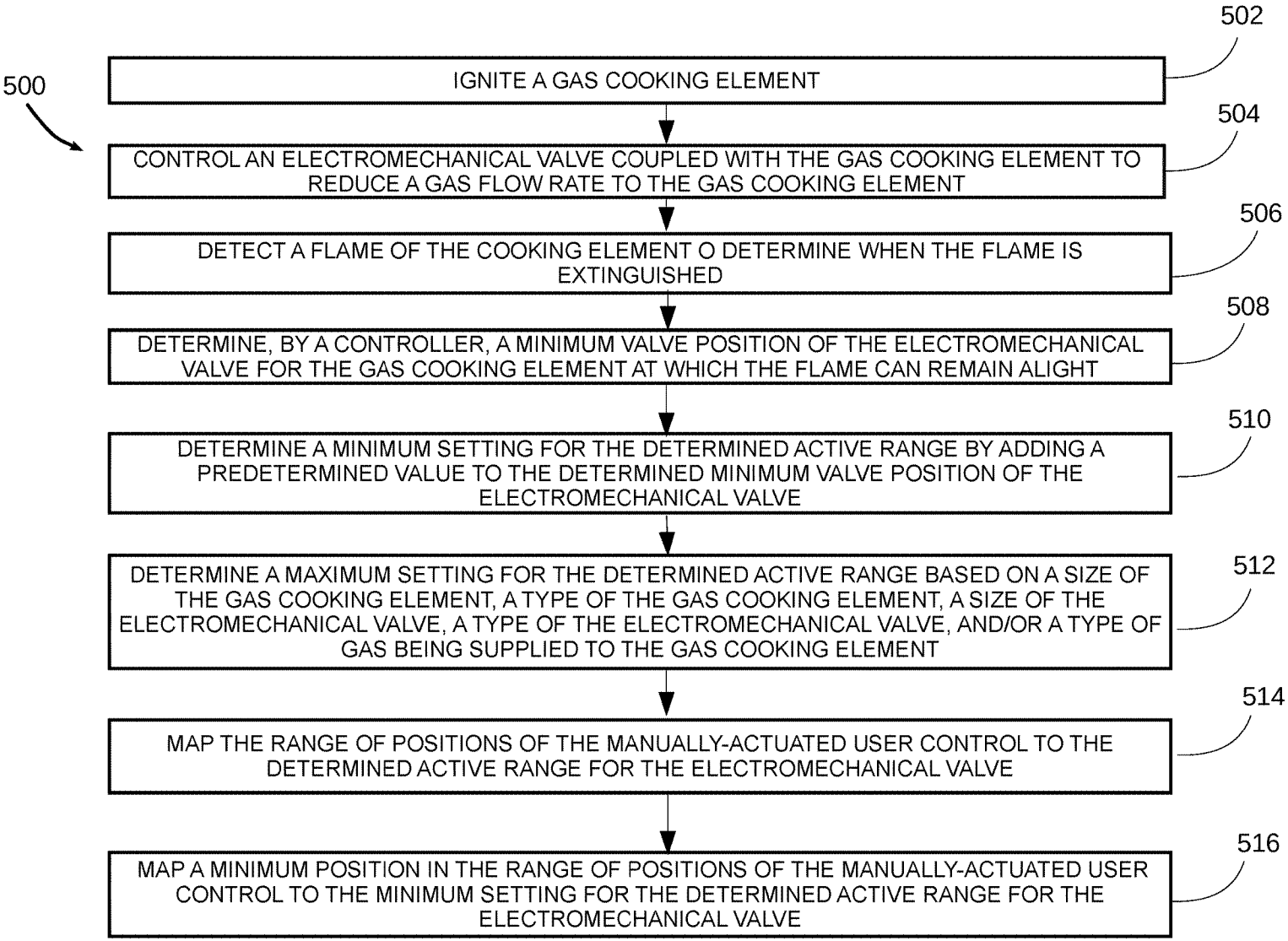
FIG. 5 is a flowchart illustrating an example adjusting sequence of operations for a gas cooking appliance, consistent with some embodiments of the disclosure.

Referring now to FIG. 5, an embodiment of a routine 500 for determining an active range for a gas cooking element (e.g. a gas burner, etc.) described herein is illustrated. Routine 500 may be implemented, for example, by the controller 130 of the cooktop control system 100 as discussed above. At block 502, the controller 130 may ignite the gas cooking element, e.g., one of the burners $B_1$, $B_2$, $B_3$, and $B_4$. This may be accomplished through the use of the corresponding igniter, e.g., one of the igniters $I_1$, $I_2$, $I_3$, and $I_4$, to create a spark while the corresponding electromechanical valve is set to an ignition position to ignite the gas supply 110 supplied to the selected burner. At block 504, the controller 130 may control the electromechanical valve coupled with the gas cooking element, e.g., the respective electromechanical valve $V_1$, $V_2$, $V_3$, or $V_4$, to reduce a gas flow rate to the gas cooking element, e.g., at a gradual or slow rate. At block 506, the controller 130 may determine when the flame is extinguished. This determination may be accomplished through the use of a flame detector, e.g., the respective flame detector $F_1$, $F_2$, $F_3$, or $F_4$. The controller 130 may then determine a minimum valve position of the electromechanical valve for the gas cooking element at which the flame can remain alight, see block 508.

In some embodiments, the routine 500 may further include determining a minimum setting for the determined active range by adding a predetermined value to the determined minimum valve position of the electromechanical valve at block 510. In some embodiments, the routine 500 may further include determining a maximum setting for the determined active range, e.g., based on a size of the gas cooking element, a type of the gas cooking element, a size of the electromechanical valve, a type of the electromechanical valve, and/or a type of gas being supplied to the gas cooking element at block 512. In other embodiments, the maximum setting may be determined empirically, e.g., by monitoring heat output while gradually increasing the gas flow rate to the gas cooking element.

In some embodiments, the routine 500 may further include mapping the range of positions of the manually-actuated user control, e.g., the respective manually-actuated user control $C_1$, $C_2$, $C_3$, or $C_4$, to the determined active range for the electromechanical valve at block 514. In some embodiments, the routine 500 may further include mapping a minimum position in the range of positions of the manually-actuated user control to the minimum setting for the determined active range for the electromechanical valve at block 516.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein, unless characterized otherwise, are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the disclosure to the precise steps and/or forms disclosed, and obviously many modifications and variations are possible in light of the above teaching. It is intended that the scope of the disclosure and all equivalents be defined by the claims appended hereto.

What is claimed is:

1. A cooktop appliance, comprising:

a plurality of gas burners;

a plurality of electromechanical valves, each of which fluidly coupled with one of the plurality of gas burners to regulate a gas flow rate thereto;

one or more flame detectors positioned to detect an active state of a flame for each of the plurality of gas burners;

a plurality of manually-actuated user controls, each of which movable over a range of positions; and a controller coupled to the plurality of electromechanical valves, the one or more flame detectors, and the plurality of manually-actuated user controls to selectively control the plurality of electromechanical valves to regulate output levels of the plurality of gas burners in response to user input received through the plurality of manually-actuated user controls, wherein the controller is configured to initiate a calibration process to determine an active range for each of the plurality of gas burners, wherein the controller determines the active range for a first gas burner among the plurality of gas burners by controlling a first electromechanical valve for the first gas burner when the first gas burner is active to reduce the gas flow rate to the first gas burner while detecting the flame of the first gas burner with a first flame detector among the one or more flame detectors until the flame is detected to be extinguished to determine a minimum valve position of the electromechanical valve for the first gas burner at which the flame can remain alight, wherein the controller is further configured to dynamically adjust a position of the first electromechanical valve in response to a change in state of one or more other electromechanical valves among the plurality of electromechanical valves.

2. The cooktop appliance of claim 1, wherein the controller is further configured to determine a minimum setting for the active range by adding a predetermined value to the determined minimum valve position of the first electromechanical valve.

3. The cooktop appliance of claim 2, wherein the controller is further configured to determine a maximum setting for the active range based on a size of the first gas burner, a type of the first gas burner, a size of the first electromechanical valve, a type of the first electromechanical valve, and/or a type of gas being supplied to the first gas burner.

4. The cooktop appliance of claim 2, wherein the plurality of manually-actuated user controls includes a first manually-actuated user control assigned to the first electromechanical valve, and wherein the controller is further configured to map the range of positions of the first manually-actuated user control to the determined active range for the first electromechanical valve.

5. The cooktop appliance of claim 4, wherein the controller is further configured to map the range of positions of the first manually-actuated user control to the determined active range for the electromechanical valve such that a minimum position in the range of positions of the first manually-actuated user control corresponds to the minimum setting for the determined active range for the electromechanical valve.

6. The cooktop appliance of claim 5, wherein the controller is further configured to map the range of positions of the first manually-actuated user control to the determined active range for the electromechanical valve further such that a maximum position in the range of positions of the first manually-actuated user control corresponds to a maximum setting for the determined active range for the electromechanical valve.

7. The cooktop appliance of claim 4, wherein the controller is further configured to map the range of positions of the first manually-actuated user control to the determined active range for the electromechanical valve by applying a scaling factor.

8. The cooktop appliance of claim 4, wherein the controller is further configured to map the range of positions of the first manually-actuated user control to the determined active range for the electromechanical valve by applying a constant offset.

9. The cooktop appliance of claim 4, wherein the controller is further configured to map the range of positions of the first manually-actuated user control to the determined active range for the electromechanical valve based upon a state of one or more other electromechanical valves among the plurality of electromechanical valves.

10. The cooktop appliance of claim 9, wherein the controller is configured to remap the range of positions of the first manually-actuated user control to the determined active range for the first electromechanical valve in response to the change in state of the one or more other electromechanical valves among the plurality of electromechanical valves.

11. The cooktop appliance of claim 1, wherein the first flame detector comprises a thermocouple or a flame sense rod.

12. The cooktop appliance of claim 1, wherein the controller is further configured to control each other gas burner among the plurality of gas burners to operate at a maximum output level when determining the active range for the first gas burner.

13. The cooktop appliance of claim 1, wherein the controller is further configured to deactivate each other gas burner among the plurality of gas burners when determining the active range for the first gas burner.

14. The cooktop appliance of claim 1, wherein the controller is further configured to operate each other gas burner among the plurality of gas burners at each of a plurality of output levels when determining the active range for the first gas burner.

15. The cooktop appliance of claim 1, wherein the controller is further configured to initiate the calibration process after conversion of the cooktop appliance to use a different type of gas.

16. The cooktop appliance of claim 1, wherein the controller is further configured to initiate the calibration process at an initial setup of the cooktop appliance.

17. The cooktop appliance of claim 1, wherein the controller is further configured to initiate the calibration process on demand in response to user input.

18. The cooktop appliance of claim 1, further comprising a user interface, wherein the controller is further configured to suggest performance of the calibration process to a user via the user interface.

19. The cooktop appliance of claim 18, wherein the controller is further configured to suggest performance of the calibration process to the user via the user interface in response to one or more flame loss conditions detected by the one or more flame detectors.

20. The cooktop appliance of claim 1, wherein the controller is further configured to override the determined active range in response to user input.

21. A cooking appliance, comprising:

a gas cooking element;

an electromechanical valve fluidly coupled with the gas cooking element to regulate a gas flow rate thereto;

a flame detector configured to detect an active state of a flame for the gas cooking element;

a user interface;

a manually-actuated user control movable over a range of positions; and a controller coupled to the electromechanical valve, the flame detector, and the manually-actuated user control to selectively control the electromechanical valve to regulate an output level of the gas burner in response to user input received through the manually-actuated user control, wherein the controller is configured to initiate a calibration process to determine an active range for the gas cooking element, wherein the controller determines the active range for the gas cooking element by controlling the electromechanical valve for the gas cooking element when the gas cooking element is active to reduce the gas flow rate to the gas cooking element while detecting a flame of the gas cooking element with the flame detector until the flame is detected to be extinguished to determine a minimum valve position of the electromechanical valve for the gas cooking element at which the flame can remain alight, wherein the controller is further configured to suggest performance of the calibration process to a user via the user interface in response to a flame loss condition detected by the flame detector.

22. The cooking appliance of claim 21, wherein the cooking appliance comprises a cooktop and the cooking element is a burner.

23. The cooking appliance of claim 22, further comprising a plurality of electromechanical valves, a plurality of manually-actuated user controls, and a plurality of burners, wherein each of the plurality of electromechanical valves corresponds to a respective manually-actuated user control among the plurality of manually-actuated user controls, and wherein each of the plurality of electromechanical valves and the respective manually-actuated user control therefor further corresponds to a respective burner among the plurality of burners.

24. The cooking appliance of claim 23, wherein the plurality of burners vary in size and/or output capacity.

25. A cooktop appliance, comprising:

a plurality of gas burners;

a plurality of electromechanical valves, each of which fluidly coupled with one of the plurality of gas burners to regulate a gas flow rate thereto;

one or more flame detectors positioned to detect an active state of a flame for each of the plurality of gas burners;

a plurality of manually-actuated user controls, each of which movable over a range of positions; and a controller coupled to the plurality of electromechanical valves, the one or more flame detectors, and the plurality of manually-actuated user controls to selectively control the plurality of electromechanical valves to regulate output levels of the plurality of gas burners in response to user input received through the plurality of manually-actuated user controls, wherein the controller is configured to initiate a calibration process to determine an active range for each of the plurality of gas burners, wherein the controller determines the active range for a first gas burner among the plurality of gas burners by controlling a first electromechanical valve for the first gas burner when the first gas burner is active to reduce the gas flow rate to the first gas burner while detecting the flame of the first gas burner with a first flame detector among the one or more flame detectors until the flame is detected to be extinguished to determine a minimum valve position of the electromechanical valve for the first gas burner at which the flame can remain alight, wherein the controller is further configured to deactivate each other gas burner among the plurality of gas burners when determining the active range for the first gas burner.

* * * * *